United States Patent [19]

Guerre

[11] 4,441,984

[45] Apr. 10, 1984

[54] RECOVERY OF OIL FROM OIL-BEARING LIMESTONE

[75] Inventor: Robert P. Guerre, Seabrook, Tex.

[73] Assignee: Exxon Research and Engineering Co., Florham Park, N.J.

[21] Appl. No.: 219,675

[22] Filed: Dec. 24, 1980

[51] Int. Cl.[3] ..... C10G 1/00; C10G 1/04

[52] U.S. Cl. ..... 208/11 LE

[58] Field of Search ..... 208/11 LE

[56] References Cited

U.S. PATENT DOCUMENTS

| | | | |
|---|---|---|---|
| 2,489,700 | 11/1949 | Coast | 208/11 LE |
| 2,825,677 | 3/1958 | Coulson | 208/11 LE |
| 3,120,488 | 2/1964 | Van DenWalt | 209/172 S |
| 4,130,474 | 12/1978 | Anthony . | |
| 4,176,042 | 11/1979 | Fahlstrom | 208/11 LE |
| 4,243,511 | 1/1981 | Allred | 208/11 R |

*Primary Examiner*—Delbert E. Gantz
*Assistant Examiner*—Helane E. Maull
*Attorney, Agent, or Firm*—Yale S. Finkle

[57] ABSTRACT

Hydrocarbon liquids are recovered from run-of-mine oil-bearing rock composed primarily of limestone by separating the rock into a low-density fraction and a high-density fraction, contacting the low-density fraction with an organic solvent in an extraction zone thereby extracting the oil from the low-density fraction, and recovering the extracted oil from the organic solvent.

12 Claims, 1 Drawing Figure

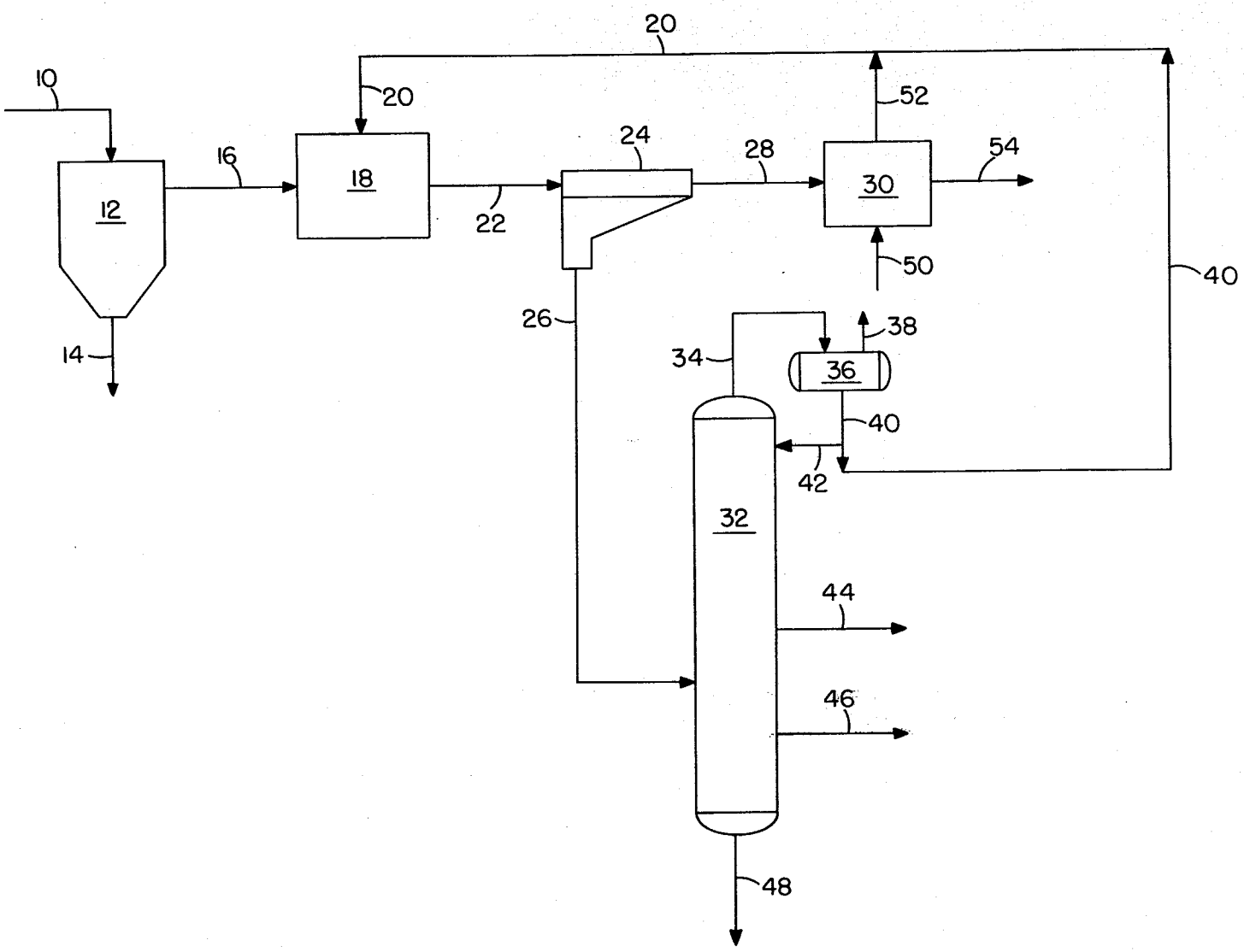
10
12
14
16
18
20
20
22
24
26
28
30
32
34
36
38
40
40
42
44
46
48
50
52
54

RECOVERY OF OIL FROM OIL-BEARING LIMESTONE

BACKGROUND OF THE INVENTION

This invention relates to the recovery of hydrocarbons from oil-bearing rock composed primarily of limestone and is particularly concerned with an above-ground extraction process which permits the recovery of these hydrocarbons in substantial quantities.

A large amount of oil exists today in the United States trapped in deposits of limestone located throughout the country. The oil normally exists in the form of an asphalt that is solid at ambient conditions. The current shortage of oil has made it highly desirable to recover liquid hydrocarbons from these heavy oil-bearing deposits. It has been suggested that conventional methods of in situ steam stimulation used in the past with success in recovering oil from tight formations of sand be applied in an attempt to recover heavy oil from limestone deposits. Such methods normally include drilling a series of several boreholes into the formation around a central borehole and injecting high pressure steam into the central borehole. The heat from the steam moves by conduction and convection outward from the central borehole decreasing the viscosity of the trapped oil and forcing it toward the other boreholes from which it is eventually recovered. Attempts to apply such methods for recovering the oil from limestone deposits in southwest Texas, however, have proven ineffective evidently because the viscosity of the oil is so great and the permeability of the formation so low that it is impossible to force the oil or steam through the limestone.

In addition to attempting to recover the oil by in situ steam stimulation, it has been suggested that the heavy oil-bearing limestone be mined and then subjected to pyrolysis in an above-ground retort thereby recovering the oil in a process similar to that used to recover liquid hydrocarbons from oil shale. Such pyrolysis processes normally involve heating the oil-bearing limestone to a temperature between about 700° F. and 900° F. in order to crack and volatilize the oil thereby forcing it out of the pores of the limestone. Although such a process works effectively, it has some major disadvantages. The primary disadvantage is that the process involves the use of substantial amounts of energy in order to heat the large volume of limestone rock that must be passed through the retort in order to produce a significant yield of liquids.

SUMMARY OF THE INVENTION

The present invention provides an above-ground process which permits the substantial recovery of liquid hydrocarbons from oil-bearing rock composed primarily of limestone which at least in part alleviates the difficulties described above. In accordance with the invention it has now been found that hydrocarbon liquids can be recovered in substantial quantities from oil-bearing rock composed primarily of limestone without the need for utilizing large quantities of heat by separating the oil-bearing rock into a low-density fraction and a high-density fraction, contacting the low-density fraction with an organic solvent to extract the oil from the low-density fraction of rock and recovering the extracted oil in the form of hydrocarbon liquids from the organic solvent. In general, the low-density fraction of oil-bearing rock will be composed of oil-bearing particles having specific gravities less than a value in the range from about 1.9 to about 2.5. Preferably, the oil-bearing rock fed to the process will be limestone from the southwest areas of Texas.

The process of the invention is based, at least in part, upon the discovery that the oil-lean particles of limestone comprising the oil-bearing rock tend to be impermeable and therefore resistant to penetration by organic solvents; whereas the oil-rich particles tend to be relatively porous and easily penetrated by such solvents. Thus, it has been found that the amount of hydrocarbon liquids recovered from the oil-bearing rock can be substantially increased by removing the higher density oil-lean particles from the feed so that only the lower density oil-rich particles are subjected to the extraction step. In general, the oil-lean particles will have a specific gravity of about 2.5 or higher and it is desirable to remove substantially all of these particles from the oil-bearing rock prior to the extraction step. By removing the oil-lean particles from the feed and selectively treating the relatively porous, oil-rich particles in the extraction step, substantially all of the oil can normally be recovered. "Oil-lean particles" as used herein include particles which contain relatively small amounts of oil and particles that are barren of oil.

It will be understood that oil shale is not within the scope of materials which can be used as a feed material in the process of the invention. The normal feed material is an oil-bearing rock in which the inorganic portion is composed primarily of somewhat porous limestone and the organic portion is asphaltic in nature and soluble in most conventional organic solvents. Oil shale, on the other hand, is a kerogen-bearing rock in which the organic portion is a polymer which is virtually insoluble in organic solvents and the inorganic portion is relatively nonporous.

The process of the invention provides an above-ground method for recovering hydrocarbon liquids from oil-bearing rock which is relatively simple and does not require the use of large amounts of energy. Thus, the process of the invention may provide a method of producing petroleum liquids from a domestic resource at a cost competitive with the cost of imported petroleum.

BRIEF DESCRIPTION OF THE DRAWING

The drawing is a schematic flow diagram of a process for recovering liquid hydrocarbons from oil-bearing limestone carried out in accordance with the invention.

DESCRIPTION OF THE PREFERRED EMBODIMENTS

In the process depicted in the drawing, run-of-mine oil-bearing limestone rock having a top size from about 2 to about ¼ inch is passed through line 10 into heavy medium washing vessel or similar device 12 where the particles are mixed with a heavy medium consisting of a sufficient amount of finely ground magnetite suspended in water to give a predetermined specific gravity which will normally range from about 2.0 to about 2.5, preferably from about 2.2 to about 2.4. The actual specific gravity utilized will normally depend upon the density variations in the oil-bearing limestone fed to the washing vessel. The particles entering the vessel that have a specific gravity higher than the specific gravity of the aqueous magnetite suspension sink to the bottom of the vessel and the feed particles having a specific gravity lower than that of the suspension rise to the top of the vessel. The high-density particles that sink to the bottom of the vessel will contain relatively small amounts of oil and the majority of the particles will be barren of oil. These particles are withdrawn from the bottom of vessel 12 through line 14 and may be used for landfill or employed in other applications which require the use of limestone.

It will be understood that in lieu of the heavy medium washing vessel shown in the drawing, other vessels or similar equipment in which gravimetric separations can be carried out may be utilized depending upon the size fraction of the particles fed to the vessel. For example, if a fraction of relatively large particles, particles having a top size between about 2 and 6 inches on the U.S. Sieve Series Scale, is being processed, a jig may be used to effect the gravimetric separation. If an intermediate size fraction containing particles between about $\frac{3}{4}$ inch and about 30 mesh to 100 mesh on the U.S. Sieve Series Scale is used, cyclones and/or concentrating tables may be used to effect the separation. Such pieces of equipment are described in the literature and will therefore be familiar to those of ordinary skill in the art.

It will be further understood that it is not necessary to utilize a gravimetric separation in order to separate the oil-bearing rock particles into a low-density and high-density fraction as described above. Since the low-density particles will be oil-rich, they will have a darker color than the high density oil-lean particles. Because of this difference in color, photometric sorting techniques can be used to separate the particles into high-density and low-density fractions. These techniques, however, are normally effective only on larger size particles. One such photometric sorting technique is described in an article entitled "Beneficiation at Large Particle Size Using Photometric Sorting Techniques" which appears in the April, 1977 issue of AUSTRALIA MINING. This article is hereby incorporated by reference.

The process of the invention is based at least in part upon the discovery that substantial increases in the amount of oil extracted from run-of-mine oil-bearing limestone can be obtained by first removing the higher density, oil-lean particles of limestone from the lower density, oil-rich particles and then subjecting the lower density particles to extraction with an organic solvent. The oil-lean particles have been found to be impermeable to conventional organic solvents and therefore have a tendency to hinder extraction of oil from run-of-mine limestone. The oil-rich particles, on the other hand, are relatively porous and are easily extracted with solvents if the oil-lean particles are not present to interfere with penetration of the solvent into the porous particles. By removing the oil-lean particles prior to the extraction, substantially all of the oil contained in the oil-rich limestone particles can be recovered by extraction.

Referring again to the drawing, the low-density fraction of oil-rich rock particles produced in washing vessel 12 by removing the oil-lean particles is withdrawn from the washing vessel through line 16 and passed to the extraction zone 18. Because these oil-rich particles are relatively porous they tend to be readily saturated with conventional organic solvents. The larger the particles, however, the more difficult it is for the solvent to completely penetrate the particles in a reasonable amount of time. Thus if the particles are overly large in size, it may be desirable to subject them to crushing prior to passing the particles to the extraction step of the process. Normally, the oil-rich particles fed to extraction zone will have a top size less than a value in the range from about 2 to about $\frac{1}{4}$ inch, preferably less than about 1 inch.

If a heavy medium washing vessel such as that depicted in the drawing is used to effect the initial separation of the oil-bearing limestone into low-density and high-density fractions, the resultant oil-rich particles will normally be of a size suitable for direct passage to the extraction step of the process and crushing will generally not be required. If, however, a jig or a photometric sorting technique is used to effect the separation, the oil-rich particles exiting the separation step will normally be larger so that crushing prior to extraction will be desirable. If crushing of the oil-rich particles is required, they can be passed to a rotary crusher or similar fragmenting device where the particles are ground, crushed or otherwise reduced in size. It is undesirable to crush or grind to a very small particle size since this requires a relatively large input of energy and is unnecessary in light of the fact that the particles are relatively porous and offer easy access to an organic solvent.

In extraction zone 18 the oil-rich limestone particles are contacted with an organic solvent or mixture of such solvents introduced into the extraction zone through line 20. In general, any organic solvent or mixture of solvents in which the oil is soluble can be employed. Examples of suitable solvents include methylene bromide, perchloroethylene, chloroform, diesel oil, xylene, kerosene, gasoline, and light fractions of the extracted oil. Since the oil contained in the particles of limestone is asphaltic in nature, it will be soluble in most conventional organic solvents.

Because the oil-rich particles fed to extraction zone 18 tend to be porous, it is relatively easy for the solvent to penetrate the particles and dissolve the oil contained therein. Thus, substantially all of the oil can be extracted in short periods of time at relatively mild conditions—atmospheric pressure and ambient temperature. Under normal circumstances, however, the solvent will be at a temperature just below its boiling point since it will normally be a recycle stream produced by fractionating the liquid effluent from the extraction zone to separate and recover the oil from the solvent. Thus, the temperature in the extraction zone will normally depend upon the type of solvent which is employed to extract the oil and the degree of cooling the solvent undergoes after it is removed from the fractionating tower and recycled to the extraction zone. If for some reason it is desirable to always use fresh solvent in the extraction zone or to cool recycle solvent, a temperature in the extraction zone between about 35° F. and about 150° F. will normally result in the extraction of substantially all of the heavy oil. The residence time of the solvent-solids slurry in extraction zone 18 will depend on the size of the particles fed to the extraction zone and the temperature at which the extraction is carried out. In general, more than about 90 weight percent of the oil contained in the particles fed to the extraction zone will be extracted by the solvent under the condition normally maintained in the extraction zone.

The effluent from extraction zone 18, which will consist of oil-depleted limestone particles slurried in a liquid mixture of solvent and extracted oil, is passed through line 22 to vibrating screen or similar separation device 24 where the oil-depleted limestone particles are separated from the slurry liquid. The vibrating screen will be designed so only the liquid mixture of solvent and extracted oil and very fine particles pass downward into line 26. The vast majority of the limestone particles, which will contain entrained solvent, remain on top of the screen and are passed through line 28 into drying zone 30. It will be understood that in lieu of vibrating screen 24 shown in the drawing, other equipment can be used to separate the oil-depleted limestone particles from the mixture of extracted oil and solvent which is withdrawn from extraction zone 18. For example, cyclones, centrifuges, and other similar equipment can be used. The type of equipment that is used will normally depend upon the size of the limestone particles in the slurry exiting the extraction zone 18.

The mixture of solvent and extracted oil withdrawn through line 26 from vibrating screen 24 along with fine particles of limestone is passed to fractionator 32 where the organic solvent is separated from the extracted oil and the fine limestone particles. The solvent, which will generally have a boiling point lower than the majority of the constituents comprising the extracted oil, will normally be removed overhead of the fractionator through line 34 along with gases and the lower boiling constituents of the extracted oil. The fractionator overhead is cooled and passed to distillate drum 36 where the gases are taken off overhead through line 38 and passed to downstream units for further processing. The liquid, which will contain solvent and lighter constituents of the extracted oil, is withdrawn from distillate drum 36 through line 40. A portion of this liquid may be returned as reflux to the upper portion of the fractionator through line 42. The remaining liquid is recycled through lines 40 and 20 to extraction zone 18.

One or more sidestreams boiling above the boiling range of the solvent are recovered from fractionator 32. In the particular unit shown in the drawing, a first sidestream composed primarily of hydrocarbons boiling above about 700° F. is taken off through line 44. A second sidestream composed primarily of hydrocarbons boiling below about 1000° F. is withdrawn from the fractionator through line 46. A bottoms fraction composed primarily of hydrocarbons boiling above about 1000° F. and fine limestone particles is withdrawn from the fractionator through line 48 and may be further processed to recover additional hydrocarbons or disposed of as landfill.

As previously mentioned, the particles of limestone containing entrained solvent withdrawn from separation device 24 through line 28 are passed to drying zone 30. Here the wet particles of limestone are passed onto a grate and contacted with hot air or similar hot gas which is passed into the bottom of the drying zone through line 50. The hot air transfers heat to the wet limestone particles thereby vaporizing the solvent. The vaporized solvent is withdrawn from the drying zone through line 52, condensed and passed into line 20 where it is mixed with the solvent recovered in fractionator 32. The combined solvent stream is then passed into extraction zone 18. Limestone from which the solvent has been vaporized is withdrawn from the drying zone through line 54 and can be used as landfill or for other purposes. The hot air passed into drying zone 30 is preferably obtained by passing ambient air in indirect heat exchange with the hot liquid streams removed through lines 44 and 46 from fractionator 32.

It will be understood that although drying zone 30 is described as containing a grate which supports the wet limestone particles while they are contacted with hot air, the drying zone may comprise a conveyor belt on which the wet particles are passed in contact with an atmosphere of gas hot enough to vaporize the solvent. Also, depending upon the solvent that is utilized, it may be desirable to use microwave or infrared energy to supply the heat in the drying zone.

It will be apparent from the foregoing that the process of the invention provides a method for recovering hydrocarbon liquids from oil-bearing limestone without the need to utilize high temperatures. As a result, it is possible to significantly reduce the amount of heat that is normally required to produce such liquids in conventional processes thereby lowering the overall cost of the liquids.

I claim:

1. A process for recovering hydrocarbon liquids from oil-bearing rock composed primarily of limestone which comprises:

(a) separating said oil-bearing rock into a low density fraction containing oil-rich limestone particles and a high-density fraction containing oil-lean limestone particles;

(b) contacting said low-density fraction containing said oil-rich limestone particles with an organic solvent in an extraction zone thereby extracting said oil from said oil-rich limestone particles; and (c) recovering the extracted oil from said organic solvent as said hydrocarbon liquids.

2. A process as defined by claim 1 wherein said oil-bearing rock comprises limestone from southwest Texas.

3. A process as defined by claim 1 wherein said separation step comprises a gravimetric separation.

4. A process as defined by claim 3 wherein said gravimetric separation is carried out in a heavy medium washing vessel.

5. A process as defined by claim 3 wherein said gravimetric separation is carried out in a jig.

6. A process as defined by claim 1 wherein said separation step comprises a photometric sorting technique.

7. A process as defined by claim 1 wherein said extraction zone is maintained at about atmospheric pressure.

8. A process as defined by claim 1 wherein said organic solvent is selected from the group consisting of methylene bromide, perchloroethylene, chloroform, diesel oil, xylene, kerosene, gasoline and light fractions of said extracted oil.

9. A process for recovering hydrocarbon liquids from run-of-mine oil-bearing limestone which comprises:

(a) subjecting said run-of-mine oil-bearing limestone to a gravimetric separation at a specific gravity in the range from about 2.0 to about 2.5 thereby separating said limestone into a low-density fraction comprised of relatively porous oil-rich limestone particles and a high-density fraction comprised of relatively impermeable oil-lean particles;

(b) contacting said low-density fraction with an organic solvent thereby extracting said oil from the relatively porous oil-rich limestone particles comprising said low-density fraction;

(c) separating the liquid mixture of solvent and extracted oil from the limestone particles comprising said low-density fraction;

(d) recovering said extracted oil from said solvent as said hydrocarbon liquids; and (e) recycling said solvent to said extraction zone.

10. A process as defined by claim 9 wherein said extracted oil is recovered from said solvent by fractionation.

11. A process as defined by claim 9 wherein said limestone particles separated from said mixture of solvent and extracted oil are heated to recover entrained solvent.

12. A process as defined by claim 9 wherein said organic solvent is selected from the group consisting of methylene bromide, perchloroethylene, chloroform, diesel oil, xylene, kerosene, gasoline, and light fractions of said extracted oil.

* * * * *